US005143366A

United States Patent [19]

Svyatsky

[11] Patent Number: 5,143,366

[45] Date of Patent: Sep. 1, 1992

[54] MAIL FEEDER

[75] Inventor: Eduard Svyatsky, Libertyville, Ill.

[73] Assignee: Bell & Howell Company, Skokie, Ill.

[21] Appl. No.: 579,380

[22] Filed: Sep. 7, 1990

[51] Int. Cl.[5] ..... B65H 3/06

[52] U.S. Cl. ..... 271/122; 271/161

[58] Field of Search ..... 271/121, 122, 125, 161, 271/188

[56] References Cited

U.S. PATENT DOCUMENTS

| | | | |
|---|---|---|---|
| 2,950,675 | 8/1960 | Copping | 271/122 X |
| 3,754,754 | 8/1973 | Peterson . | |
| 3,857,559 | 12/1974 | McInerny | 271/122 |
| 3,970,298 | 7/1976 | Irvine | 271/122 X |
| 4,061,329 | 12/1977 | Sachuk et al. . | |
| 4,203,586 | 5/1980 | Hoyer . | |
| 4,368,881 | 1/1983 | Landa . | |
| 4,420,151 | 12/1983 | Kobayashi . | |
| 4,522,385 | 6/1985 | Stefansson . | |
| 4,674,736 | 6/1987 | Tsubo . | |
| 4,709,911 | 12/1987 | Saiki et al. . | |
| 4,753,433 | 6/1988 | Rodi et al. . | |
| 4,822,023 | 4/1989 | Miyoshi . | |

FOREIGN PATENT DOCUMENTS

| | | |
|---|---|---|
| 61242 | 5/1981 | Japan . |
| 829719 | 3/1960 | United Kingdom . |

*Primary Examiner*—Richard A. Schacher

[57] ABSTRACT

A document separation system including at least one separation roller system having a cooperative pair of driver and separation rollers providing a nip for the acceptance of a document between the cooperative rollers, whereby the rollers are capable of rigidifying the document by applying a beam to the document, resulting in an economical system for handling foldover documents mixed in with normal enveloped documents.

8 Claims, 7 Drawing Sheets

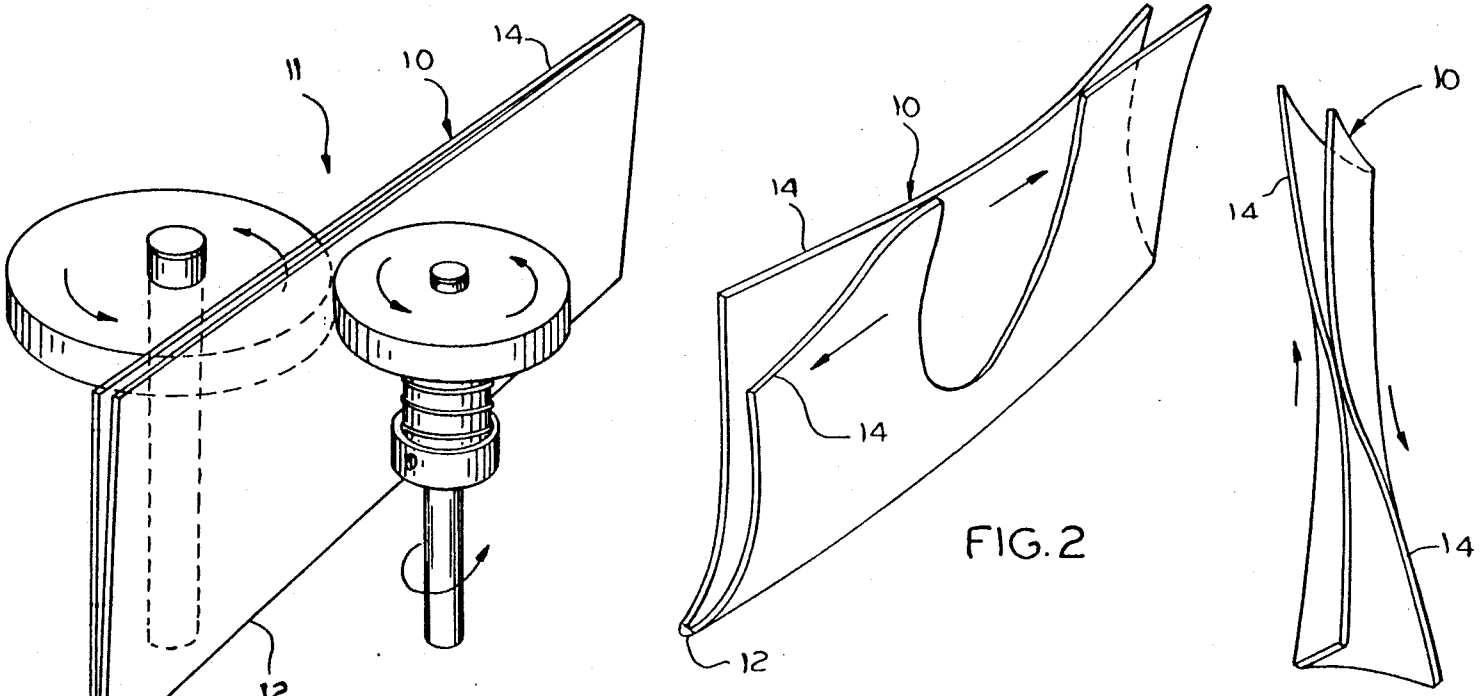
FIG.3
FIG.2
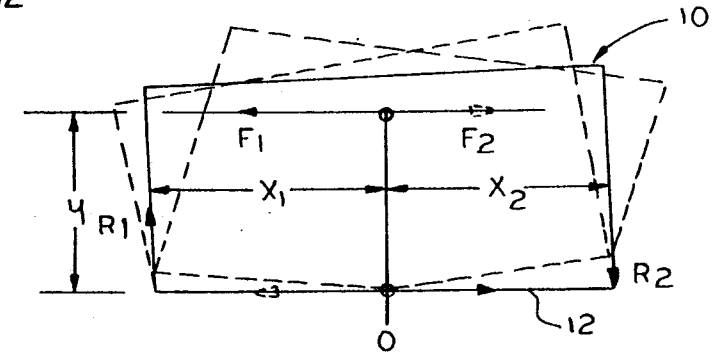
FIG.4
FIG.1

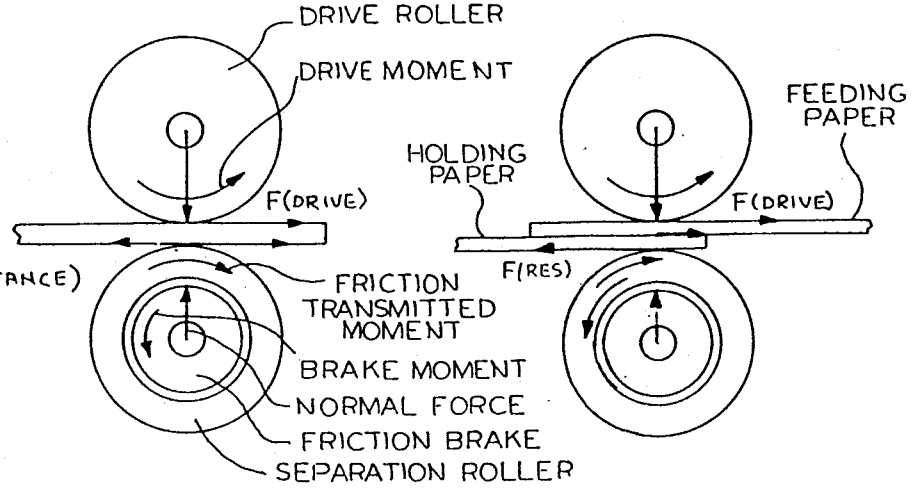
FIG. 23
FIG. 22
PRIOR ART
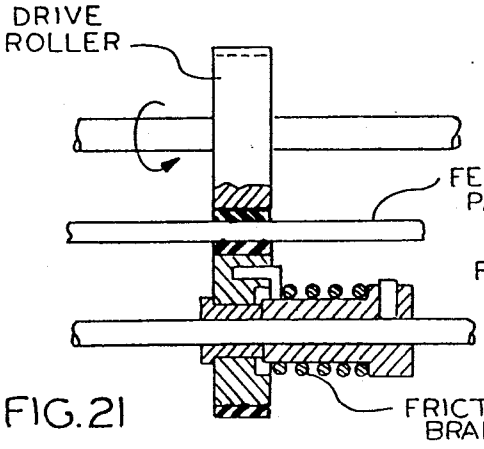
FIG. 21
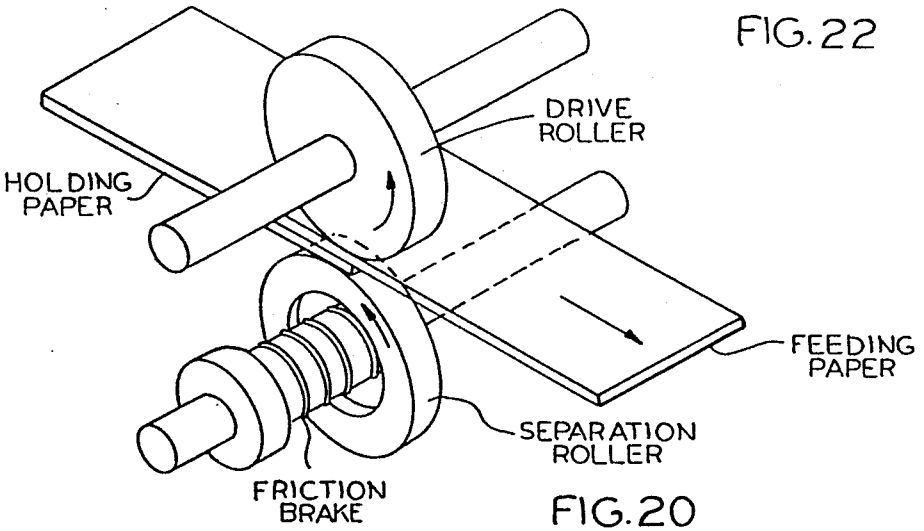
FIG. 20

MAIL FEEDER

State of the art mail handling equipment generally utilizes bar code printing and reading equipment to facilitate mechanized automatic handling of bulk document or envelope mail. In order to accomplish either the printing or the reading of such mail it is necessary to retrieve and feed individual pieces of mail from a stack, separate the individual pieces when two or more pieces are fed from the stack, and present each document in an orderly oriented fashion to be operated upon and/or sorted after its bar code is read.

In such existing feeder equipment, some of which is manufactured by the assignee of the present invention, the equipment utilizes a separation roller system. This system is based on the principle that different coefficients of friction, $\mu$ are present between the feeding element and envelopes, the separation element and envelopes, and between the envelopes themselves.

BACKGROUND OF THE INVENTION

The basic elements of the separation system are the drive roller and the separation roller (see FIGS. 1 and 20). The drive roller is rotated in a counterclockwise direction (as seen in FIG. 1) by a control motor (not shown) while the separation roller shaft is rotated in the same counterclockwise direction while the separation roller rotation is inhibited by a friction brake mounted on its shaft. When the drive and separation rollers are brought into direct engagement, or when only a single envelope is located in the nip between the rollers, the effect of the friction brake is over-ridden and the separation roller is permitted to reverse its rotation and to move in the same direction as the drive roller at the point of tangency where they contact one another. The separation shaft is spring loaded laterally to create the normal force N between drive and separation rollers. An implementation uses a pair of co-axially disposed rollers (one upper and one lower, on the same shaft) coupled together as a pair of drive rollers and a pair of separation rollers. However, the principal of operation is the same as the single roller illustrated.

In the process of rotating the drive roller with no material in the nip, a drive force $F_{DR}$ is created as a result of the normal force N and the coefficient of friction between the rollers This drive force $F_{DR}$ overcomes the resistance force $F_{RESIST}$ (from the spring brake) on the separation roller allowing the drive and separation rollers to rotate together in the direction of the drive roller at the point of tangency where they meet. This resistance force can also be referred to as the separation force. (See FIGS. 23 and 24)

When a single envelope arrives between the drive and separation rollers the drive force $F_{DR}$ will be applied from the drive rollers to the envelope and transmitted through the opposite side of the envelope to the separation roller where it overcomes the resistance force $F_{RESIST}$ of the brake and rotates the drive and separation rollers in the direction of the feeding envelopes. If the resistance force is too high, such that it exceeds the envelope material strength, damage to the mail will result.

If two envelopes arrive together (double feed) between the drive and separation rollers, the drive force $F_{DR}$ will be applied to the first envelope and transmitted to the opposite side of the envelope. There it overcomes the influence of the friction forces between the first and second envelopes, allowing the first envelope to pass in the direction of feeding. The second envelope is held by the separation force, $F_{RESIST}$, where it remains stationary until the first envelope passes through the separation station. This occurs since the friction between envelopes is less than the friction between the rollers and the envelopes. The second envelope is then treated as a single envelope and follows the first Feeders of this type demonstrate excellent results and run significantly better than the rejection requirements established by the U.S. Postal Service.

In order to provide savings in the cost of communications with customers, many organizations are utilizing single or multiple sheets that are merely folded over and fastened at a limited location along the free edges opposite the fold. It has become apparent that a compromise must be made between handling regular material such as envelopes and handling foldovers in the separation system set forth above. While handling regular enveloped material it was found best to increase the separation force as much as the structural integrity of the enveloped material will permit. This provides the fewest doubles delivered since the difference between the separation force and the friction force between envelopes is maximized.

SUMMARY OF THE INVENTION

A basic object of the present invention is to provide an economical system for handling foldover mail as it is mixed in with the normal envelope mail.

The solution of this problem must be directed at the elements that contribute to the structure of the foldover, namely, its coefficient of friction, its natural rigidity and reinforcement of this rigidity along the area of the fold, and the lack of material coupling along the edges of a foldover reducing its strength relative to sealed envelopes.

To handle foldover materials, it is best to reduce separation forces as much as possible High separation forces may destroy the foldover due to its generally lower structural strength, spelled out above. The solution provided by the present invention is to provide an artificial beam in the area where the separation roller contacts the material. This reinforces the rigidity of the foldover document in the area where the initial force is applied. Preferably, the rigid beam is oriented in the same direction as the initial force This concept is clearly illustrated by the embodiments shown in the accompanying drawings and specification.

BRIEF DESCRIPTION OF THE DRAWINGS

FIG. 1 is a perspective view of a foldover document confronted by the cylindrical shaped drive and separation rollers described above;

FIG. 2 is a perspective, view without the rollers of FIG. 1, showing the distortion and separation of the free edges of the foldover document when acted upon by separation rollers, not shown;

FIG. 3 is a top view of the foldover document shown in FIG. 2 showing the axial shifting of the free edge of the foldover document when acted upon by the drive and separation rollers, not shown;

FIG. 4 is a schematic force diagram of the forces applied to a foldover document by separation rollers;

Figure 11:
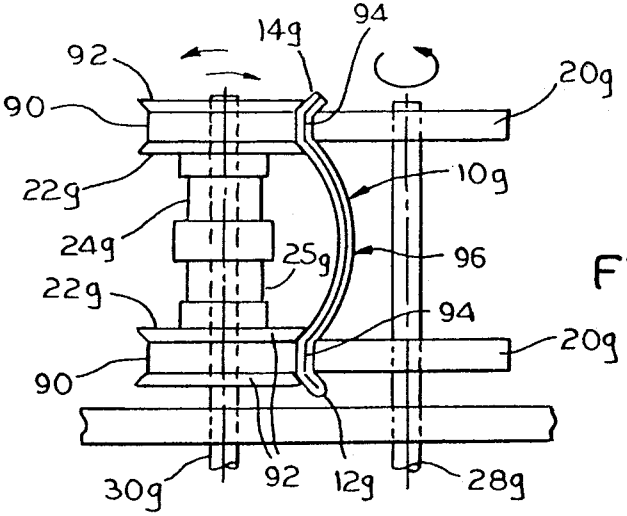
Figure 14:
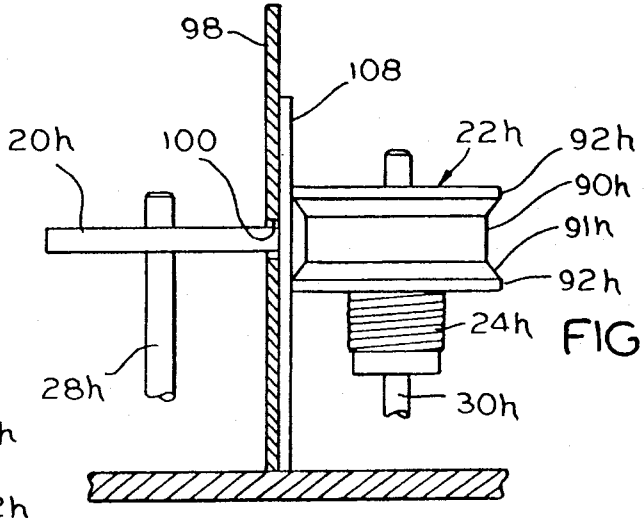
Figure 15:
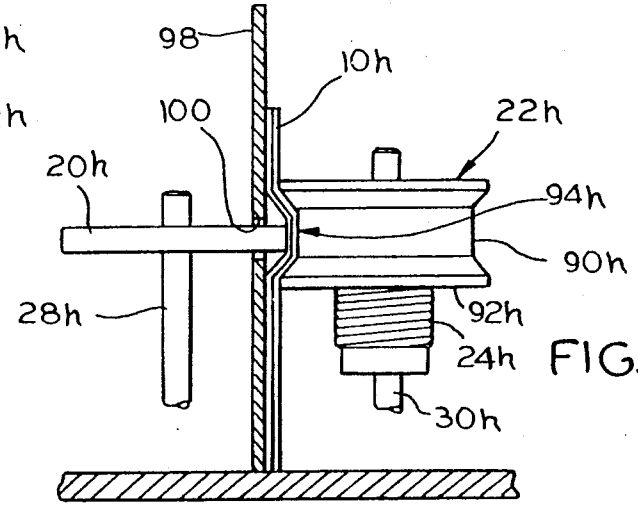
Figure 13:
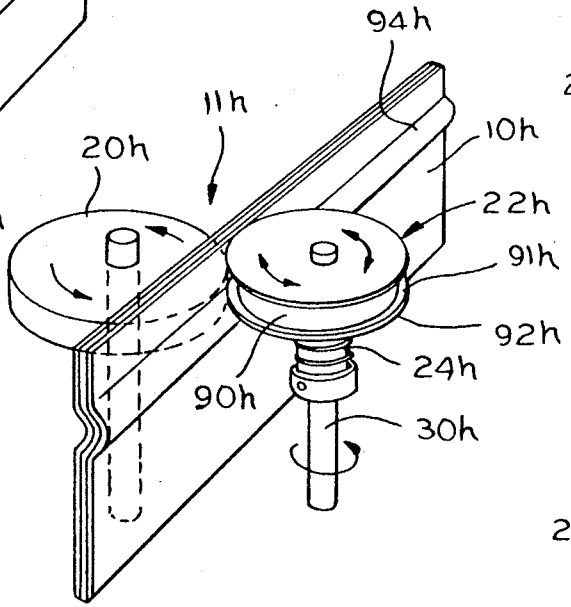
Figure 12:
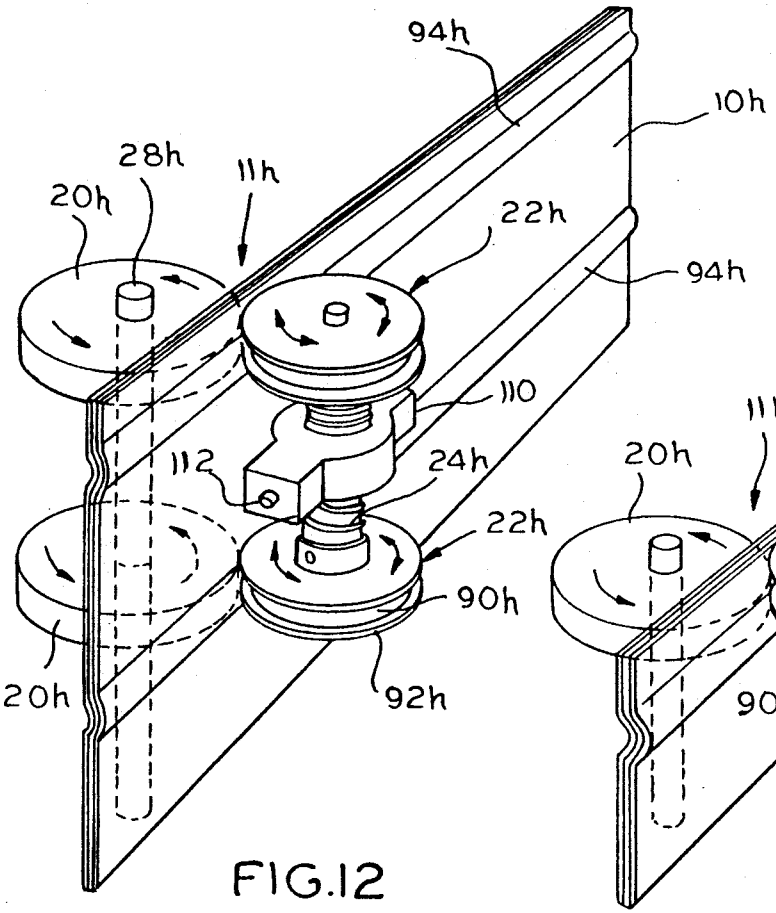
Figure 16:
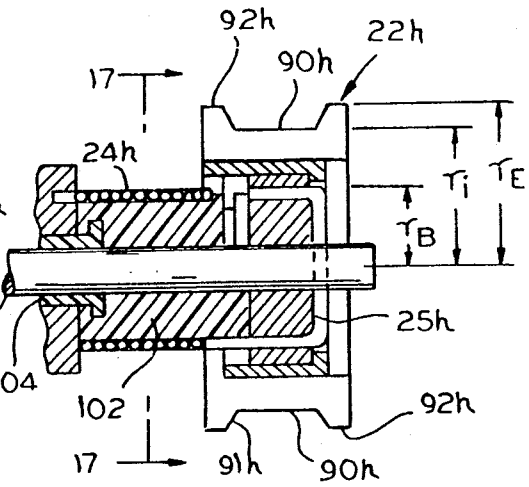
Figure 17:
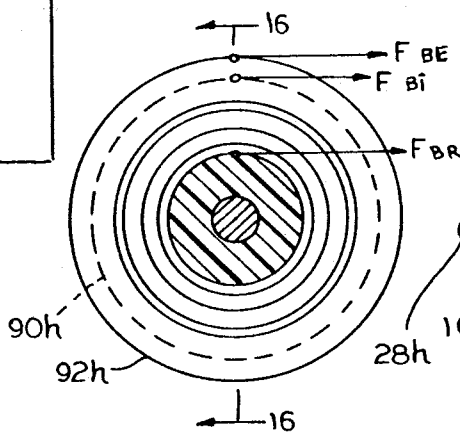
Figure 18:
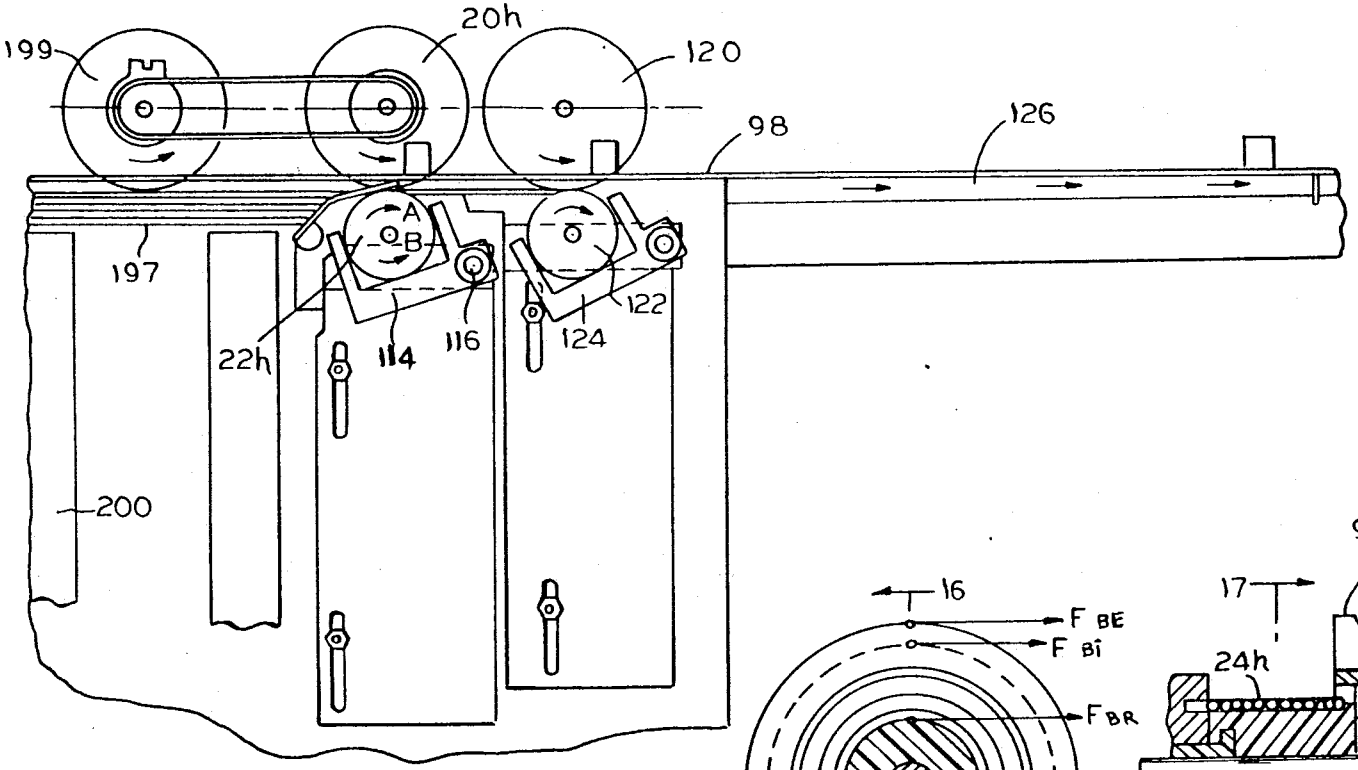
Figure 19:
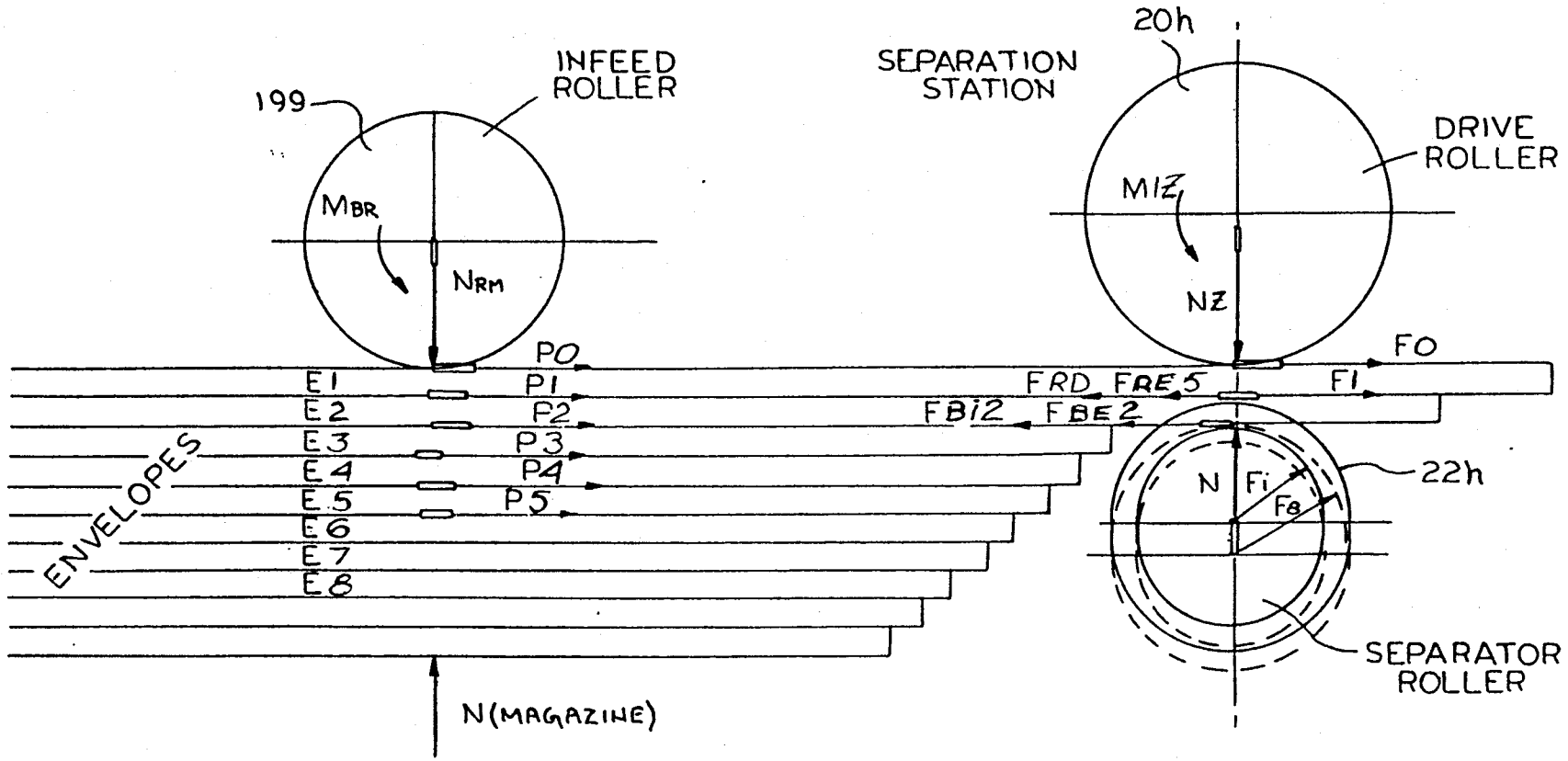

FIG. lo is a partial schematic end view of a system wherein the drive and separation roller shafts each include a pair of axially spaced rollers having limited axial extent and confronting one another in spring-loaded relation adjacent the folded edge and the spaced free edges and at least one of said shafts carrying an intermediate free spinning roller located intermediate between one set of said axially spaced rollers, said free spinning roller having a convex exterior which causes the foldover document to deflect thereby forming an effective concavo-convex shaped beam;

FIG. 11 is a partial schematic end view of a system wherein the drive and separation roller shafts each include a pair of axially spaced opposing roller means, each of said pairs of opposed rollers including a recessed external periphery and the opposed roller being complimentary thereto, thereby drawing said intermediate material into a concave-convex shaped transverse section beam-like configuration;

FIG. 12 is schematic perspective view of a pair of axially spaced concave rollers on a separation shaft and a pair of complimentarily axially spaced opposing rollers on a drive shaft forming a pair of spaced concave-convex grooves on a foldover document which act as a pair of beam-like means;

FIG. 13 is a schematic perspective view of a single pair of opposed concave-convex rollers forming a single groove-like beam means adjacent the free edges on a foldover document;

FIG. 14 shows an end sectional view of a system including a base member, a vertical supporting wall member that is slotted intermediate its length to accept a spring-loaded cylindrical drive roller therethrough and a concave separation roller providing inner and outer radially extending peripheral portions, this illustration showing its usage with a rigid envelope enclosed document wherein the outer peripheral portions ride on the envelope surface;

FIG. 15 shows the same system shown in FIG. 14 but with a foldover document which is deformed by the spring-loaded drive roller into the cavity of the concave grooved separation roller;

FIG. 16 is a partial axial cross-sectional view of a spring braked concave grooved separation roller taken along line 16—16 of FIG. 17;

FIG. 17 is a partial transverse section taken along line 17—17 of FIG. 16 and including force arrows positioned at the outer extremities of the brake and at the critical points of the concave roller;

FIG. 18 is a schematic plan view of a mail stack delivery means including infeed roller means; the laterally moving separation means and an acceleration means delivering separated documents to a transporter means carrying the documents to further operations;

FIG. 19 is a schematic elevational view of an infeed roller and a drive-separation roller combination showing the operation of the separation roller when confronted by more than one document presented by the infeed roller;

FIG. 20 is a partial perspective view of a prior art drive roller and separation roller combination;

FIG. 21 is a side elevational view in partial section of the drive and separation rollers shown in FIG. 20;

FIGS. 22 and 23 are schematic end or axial views of the drive and separation rollers showing the forces involved when the drive and separation rollers of the prior art encounter a single and a double layer of documents, respectively.

DETAILED DESCRIPTION

The handling of foldovers by the prior art feeders was studied. In the investigation it became apparent a compromise must be made between handling regular material and foldovers in the separation system. While handling regular material our studies found it best to increase the separation force as much as the structural integrity of the material will permit. This provides the fewest doubles since the difference between the separation force and the friction force between each envelope is maximized.

To handle foldovers, it is best to reduce separation forces as much as possible. High separation forces in the separation station 11 (FIG. 1) may destroy the foldover due to its generally lower structural strength. This conflict is based on the specific property of the foldover 10, as schematically seen in FIGS. 1–4. The elements that contribute to the structure of the foldover 10 are its coefficient of friction, natural lack of rigidity, and reinforcement of this lack of rigidity along the area of the fold 12. The lack of material coupling along the free edges 14 of a foldover reduces its strength when compared with the relative strength of sealed envelopes. The distortion of the static equilibrium between the pages of a foldover document occurs as a result of unbalanced twisting moments applied to the opposite side and direction of the foldover. To maintain a static relationship between the pages of the foldover, it is necessary that the sum of the moments applied to each side of the foldover equal zero. The sum of the moments applied to the material by the separation rollers is described by the following equation with reference to FIG. 4:

$$\Sigma M_0 = F_1Y - R_1X_1 - R_2X_2 = O$$

$F_1$ = initial force of the roller $R_1$ & $R_2$ = reaction forces originated in the area of the fold and equalized by the initial force.

In the analysis of the above equation the reaction forces $R_1$ and $R_2$ are a function of the material and cannot be controlled in the process of feeding material. $F_1$ is the drive force applied by the rollers to the material and determined as a function of the normal force N between the paper and roller along with the coefficient of friction $\mu$ between the material and drive roller.

$$F_1 = N \cdot \mu$$

Because of specific requirements on the value of the drive and separation forces, $F_1$ and $F_2$ cannot be changed. Coordinates $X_1$ and $X_2$ are a function of the length of the document, the sum of $X_1 + X_2$ = the length of the envelope, which is unique for each mail piece and cannot be controlled.

Only one variable parameter Y is left. Y is the moment arm of the applied force $F_1$ to the document in relation to the rigid beam originated from the fold of the document. If Y=O then $F_1Y$=O, which means the moment originated by the initial force in relation to the rigid beam of the document is absent and as a consequence the moment that twists the rigid beam around pivot point 0 is also absent. Point 0 is the projection of the application point of the initial force to the rigid beam of the foldover.

Because the width of each document varies substantially and the fold can occur on either the bottom or the top, as viewed in the drawing, the location of the rigid beam in relation to the application point of the initial force cannot be predicted. In this case it would not be practical to place the separation roller system in the area of the fold to achieve a condition where Y =0. However, it is possible to artificially create a rigid beam in the area where the separation roller contacts the material.

Referring now to FIGS. 5 through 15, a plurality of embodiments implementing the concept spelled out above are shown, and wherein similar parts are designated by similar numerals with alphabetical suffices to more particularly describe the particular embodiments.

Figure 5:
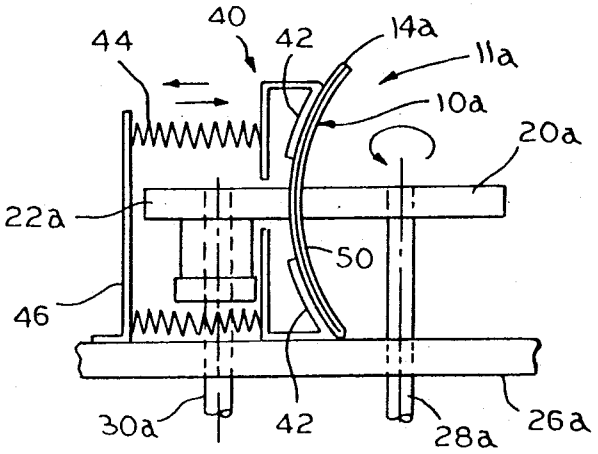
FIG. 5 a partial schematic elevational end view of normal cylindrical separation rollers positioned centrally within a spring-loaded means acting against the upper and lower longitudinally disposed portions of the foldover document to cause the document to flex and form a shallow concave beam configuration.

The separation station embodiment 11*a* shown in FIG. 5 includes a base 26*a* supporting a pair of spaced parallel power shafts 28*a* and 30*a* which carry the drive roller 20*a* and separation roller 22*a*, respectively. In this embodiment the production of a beam-like concave configuration 50 in document 10*a* is accomplished by means of the deforming means 40 having a pair of spaced concave deflection surfaces 42 which extend beyond the vertical plane coincident with the tangent falling on the contact point of the rollers 20*a* and 22*a*. The deforming means 40 causes the document 10*a* to deflect into the concave configuration 50 as seen in FIG. 5. The surfaces 42 are spring loaded by springs 44 acting against the fixed stop means 46 and are provided with movement limitation stop means, not shown, for controlling the extent of deflection of a foldover 10*a* thereby limiting the deflection to reasonable norms. The force of separation is brought to bear at the middle of beam 50 at a position of zero moment as set forth above.

Figure 6:
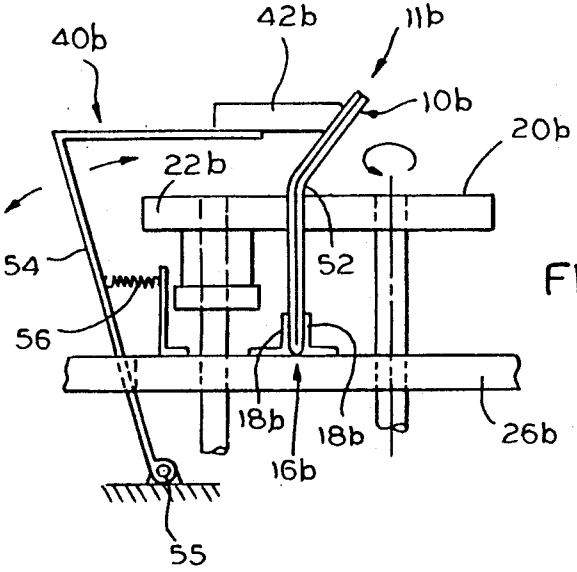
FIG. 6 is a partial schematic end view of a system wherein the separation rollers contact the mid-section of the foldover document, the fold is restrained within guide rail means and a spring-loaded means acts against the upper free edges of the document to cause it to flex about its mid-point, to thereby form a V-shaped beam member.

In FIG. 6, a second separation station 11*b* includes the powered drive roller 20*b* and separation roller 22*b*, channel lateral retaining means 18*b* and a single deforming means 40*b*. Means 40*b* in this embodiment includes a single deflection surface 42*b* mounted on a bent arm 54 pivoted about point 55 and intermediately spring-loaded as shown at 56. This causes the foldover 10*b* to bend at the point of contact 52 within the nip of rollers 20*b* and 24*b*. Thus, a V-shaped beam is created in the foldover 10*b* to resist the forces produced in the separation station 11*b* and with the forces located at zero moment at the valley of the beam 52.

Figure 7:
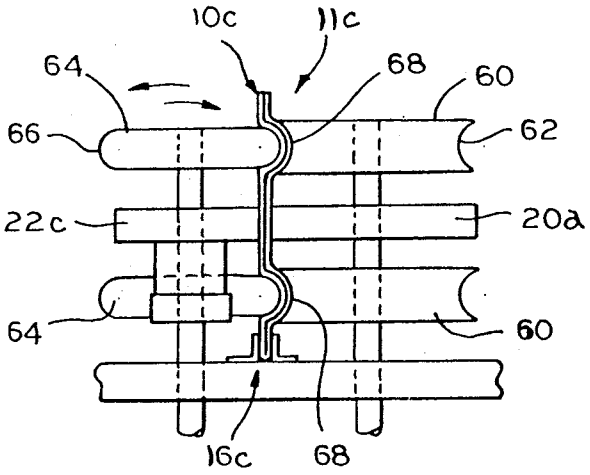
FIG. 7 is a partial schematic end view showing a system wherein two pairs of spaced concave-convex opposed roller means create a pair of spaced, axially disposed U-shaped channels or beam means on opposite sides of the intermediately disposed separation roller system to rigidify the foldover document during separation.

The next embodiment, shown in FIG. 7, is a separation station 11*c* having a drive roller 20*c* and a separation roller 22*c*, with at least one set of complimentary deformation rollers that include a roller 60 having a concave peripheral groove 62 and a complimentary roller 64 having a substantially convex peripheral configuration 66 that mates with groove 62 to deform the foldover 10*c* to form the beam-like configuration 68. In the specific embodiment shown in FIG. 7, two pair of rollers 60 and 64 are provided in axially spaced relation above and below the nip of the drive and separation rollers 20*c* and 22*c*, respectively. Thus, a device embodying the teachings of this embodiment will produce one or more separation reinforcing beams 68 for assisting in the prevention of distortion of the foldover 10*c* in the separation station 11*c* and being positioned in counterbalanced relation on opposite sides of the separation force. A lateral restraining means 16*c* may also be included to further assist against distortion or deformation of the foldover 10*c*.

Figure 9:
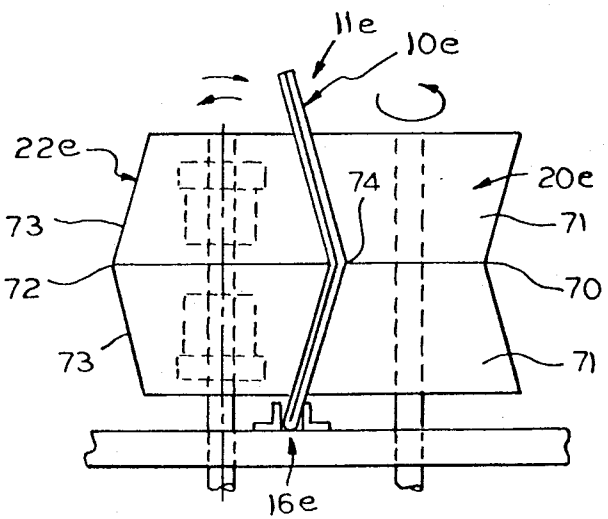
FIG. 9 is a partial schematic end view showing a drive roller having a pair of frusto-conical sections with the narrow ends abutting and flaring axially outwardly from the central portion thereof, while the separation roller includes a pair of frusto-conical sections having their enlarged ends in abutting fashion with these combined sections being complimentary in angular relationship to the frusto-conical drive roller sections.
Figure 8:
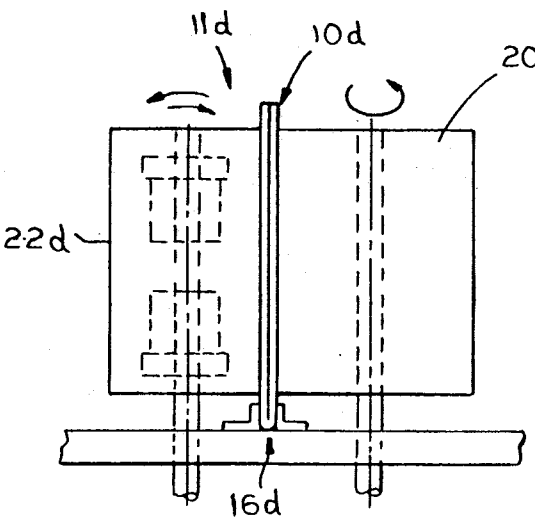
FIG. 8 is a partial schematic end view showing a system wherein a pair of cylindrical rollers having substantial axial extent embrace a foldover document throughout substantially all of the vertical extent of the document as it passes along a pair of guide rails.

Referring now to FIGS. 8 and 9, the drive and separation rollers 20*d*–22*d* and 20*e*–22*e* embrace a substantial extent of the the width of foldovers 10*d* and 10*e*, respectively. In the fifth embodiment of FIG. 8, the two rollers are substantially cylindrical in nature and apply the force over substantially the major portion of the foldover 10*d*'s entire vertical extent and prevent any moment arm to develop and hence they reinforce the rigidity of the document on opposite sides in the area where the initial force is applied.

The embodiment of FIG. 9 is related to FIG. 8 in that it engages a substantial portion of the vertical extent of the document 10*e*, however, the drive roller 20*e* consists of two frusto-conical sections 71 having their minor diameters interconnected to form a concavity as represented by their line of juncture 70. The separation roller 22*e* is similarly formed by two complimentary frusto-conical sections 73 that are joined at their major diameter as defined by the juncture line 72 forming a convex configuration that is mateable with the drive roller 20*e*. In this embodiment there is not only the engagement of a substantial portion of the foldover's vertical extent but also the creation of a a-shaped beam-like configuration as indicated at the numeral 74 to reinforce the rigidity of the document in the area where the initial force is applied and with the rigid beam being oriented in the same direction as the initial force.

Figure 10:
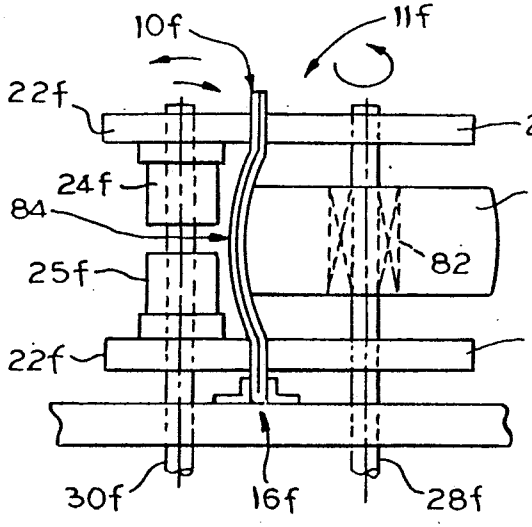

Another embodiment is shown in FIG. 10 wherein a pair of axially spaced drive rollers 20*f* and a parallel pair of separation rollers 22*f* are positioned in paired opposition thereto The friction brake means 24*f* and 25*f* being mounted to the same power shaft 30*f* are of opposite hand, i.e., one is of right hand release while the other is of left hand release so that both will grab or permit limited rotation dependent upon the direction of rotation of the powered shaft 30*f*. Mounted on shaft 28*f* intermediate the drive rollers 20*f* is a free spinning roller 80 having a convex periphery that is of slightly larger diameter than the drive rollers 20*f*. The roller 80 is mounted on bearing 82 fixed to the shaft 28*f*. The roller 80 causes the document 10*f* to form a concavo-convex beam-like section 84 which reinforces the rigidity of the document 10*f* and with the gripping of the document at the top and bottom of the foldover document results in a reinforced rigidity that is beneficial to the handling of such documents.

Still another embodiment is shown in FIG. 11, wherein a pair of axially spaced cylindrical drive rollers 20*g* are mounted on a common powered drive shaft 28*g*. A parallel separator shaft 30*g* carries a pair of spaced separation rollers 22*g* in opposition to the rollers 20*g*. These separation rollers 22*g* are unique rollers having a minor diameter 90 that is generally cylindrical while the faces of the rollers have a tapered wall 92 that create a concave groove on the periphery of each roller 22*g*. The axial extent of minor diameter 90 is substantially similar to the axial extent of roller 20*g* so that the latter is readily accepted within the peripheral groove of rollers 22*g*. In the illustrated embodiment the drive rollers 20*g* depress the foldover 10*g* adjacent the fold 12*g* and the adjacent the opposite free edges 14 to form the rigid beam-like depressions 94. An additional elongated concavo-convex beam 96 is deflected between the nips of the upper and lower pairs of the drive and separation rollers to further rigidify the foldover 10*g* when confronted by the forces of separation imposed by the drive-separation rollers 20*g*–22*g* on the twin beam-like channels 94 that are spaced on opposite sides of beam 96.

A preferred embodiment of the present invention can be found in FIGS. 12 through 17 which uses the special profile of the separation roller 22*h* wherein the roller 22*h* has a circumferential groove with a base 90*h* of substantial axial extent that is surrounded by a pair of opposed outwardly sloping circumferential walls 91*h* ending in the outer or external radius 92*h* of limited axial extent. The drive roller 20*h* that is associated with the separation roller 22*h* is a cylindrical roller of limited axial extent so that it will be substantially complimentary with the inner radius or base 90*h* and be capable of deflecting the foldover 10*h* into a beam-like configuration 94*h*.

The profile or crosssectional configuration of beam 94*h* creates an artificial beam on the document 10*h* reinforcing the rigidity of the document in the area where the initial separation force is applied by the rollers. In addition, the rigid beam 94*h* is oriented in the same direction as the initial force. In this case the twisting moment relative to the newly formed rigid beam will equal zero (0) and the initial force will be applied along the beam of rigidity which prevents twisting of the document. The schematic illustration of such a separation unit 11*h* is seen in FIG. 13.

A modification to this concept is the presentation of axially spaced pairs of drive-separation rollers 20*h*–22*h* as shown in FIG. 12. In this embodiment the separation rollers are carried by a bearing means 110 having laterally extending arms carrying dogs 112 for engagement with a pivotable yoke 114 (see FIG. 18) moving about the pivot point 116 in a spring-loaded fashion (the spring means not being shown). More details of the arrangement shown in FIG. 18 will be set forth hereinafter.

FIGS. 14 and 15 schematically illustrate a barrier wall 98 against which the documents 10*h* and 10*j* are aligned. A slot-like aperture 100 accepts the periphery of spring loaded drive roller 20*h* for engagement with the document being fed. In FIG. 14, a substantially rigid document, such as envelope 10*j*, is engaged by the external outer peripheral radius 92*h* of the separation roller 22*h*, while in FIG. 15 a foldover 10*h* is engaged by drive roller 20*h* and depressed into the inner radius or base 90*h* of the separation roller 22*h*'s groove to form the beam 94*h*, as was done in the embodiments of FIG. 12 and 13.

The schematic showing of the application of such teachings to a commercial device can be seen in plan view in FIG. 18 wherein a stack of documents 197 are fed (upwardly in the drawing) until the foremost document is brought into engagement with wall 98 which is slotted to permit infeed roller 199 to feed the first document laterally into the nip between drive roller 20*h* and separation roller 22*h* where the separation process previously described takes place. A separated document is laterally fed into the nip between acceleration rollers 120–122 mounted on the yoke 124 and other spring-loaded means, not shown, for delivery of the document to the transport means 126 for delivery of the document to other processing means, i.e., bar code printer, reader, cancellation equipment, etc.

The effectiveness of this concept has been proven with the installation of concave shaped separation rollers on prior art feeders of the type shown schematically in FIGS. 1 and 20 through 23. With the new improved concave separation roller profile it was possible to feed intermixed foldovers and semi-rigid mail previously considered non-machinable (not capable of being handled together in separation machinery) through the separation station with reliable separation and without destroying the material.

The technique is effective, however, in the process of moving multi-varied documents through the separation station where soft flexible documents will be formed in the shape of the roller profile and contact the internal radius surface 90*h* (i.e., the internal radius ri shown in FIG. 16) of the separation rollers (see FIGS. 15,16).

In the process of moving rigid and semi-rigid documents, i.e. envelopes, through the system, these documents will overcome the normal spring-loaded force between the drive-separation rollers and spread them apart. In these cases the document will not conform to the profile of the roller 22*h* and the contact point 92*h* between the roller and paper will be located on the outside radius $r_E$ of the separation roller 22*h*. Because this separation system utilizes a constant moment friction brake 24*h*, i.e. the moment $r_B$ changing the radius $r_i$ and $r_E$ in which rollers contact the document will change the magnitude of the brake force $F_{Bi}$ and $F_{BE}$ which is applied through the separation rollers 22*h* to the document 10*h*, see FIGS. 16 and 17.

An analysis of these factors leads to the conclusion that in the process of moving rigid documents through such a separation system the radius $r_E$ increases, resulting in a proportional decrease of the separation force $F_{BE}$. Decreasing the separation force might increase the rate of doubles of regular mail, however, the result is much improved foldover separation performance. The results illustrate that due to the lower proportion of doubles of foldovers in the tested mail stream, the improvement is more than offset by the lower performance of standard mail pieces.

The principle on which this separation system is built is based on differences between the sum of the drive forces $\Sigma F_{DR}$ and the sum of the resistance forces $\Sigma F_{RESIST}$ (see FIG. 19).

Referring to FIG. 19 and the schematic force diagrams therein, in the process of feeding the first envelope El the sum of the drive forces must be greater than the sum of the resistance forces. However, in the case of separating the second envelope $E_2$ the sum of the drive forces must be significantly smaller than the sum of the resistance forces.

Envelope $E_1$: $\Sigma F_{DR} > \Sigma F_{RESIST}$;

Envelope $E_2$: $\Sigma F_{DR} > \Sigma F_{RESIST}$;

The sum of the resistance forces is determined by the maximum allowable force without damaging the feeding documents. The resistance forces cannot be increased without the risk of damaging these documents. The only apparent variable is the reduction of the sum of the drive forces.

By analyzing the applied forces (see FIG. 19) on the documents it becomes clear that the feeding components $F_0$ and $F_1$ from the separation system are a function of the normal force N and the corresponding coefficients of friction $\mu$ and cannot be changed without significant influence on the parameters of the separation forces $F_{BE}$ and $F_{Bi}$.

The sum of the drive forces depend on the variation of the components $P_0$, $P_1$, $P_2$, etc. These components are a function of the normal force in the magazine $N_N$ and the corresponding coefficient of friction. Because the coefficient of friction is a function of material and cannot be controlled, the only remaining parameter left to solve this problem is the normal force in the magazine.

When the normal force in the magazine is reduced it also proportionally reduces the drive components $P_1$, $P_2$, etc., which reduces the sum of the drive forces. The working conditions for the separation system can be improved by reducing the magnitude of components $P_1$, $P_2$, etc., in the magazine with the exception of $P_0$. This analysis was confirmed when several experiments were run on the separation system itself without the influence of the magazine pressure $N_N$ on the infeed roller 199. Under these conditions the separation system demonstrated a very high degree of reliable separation of all forms of mail.

As can be seen, in order to compensate for the side effect resulting from this improved separation roller system, it is necessary to reduce the negative effect from the magazine pressure and improve the operation system of the feeder.

Other variations in configuration and approach will be apparent to those skilled in the art but it is intended that all equivalents be included herein and restriction is limited only by the parameters of the attached claims.

I claim:

1. A document separation system including at least one separation roller system having a cooperative pair of drive and separation rollers defining a nip therebetween for receiving foldover documents, said drive and separation rollers being located on parallel spaced shafts and operative to contact said foldover documents medially between opposite free longitudinally disposed edges, spaced beam forming roller means disposed in axially spaced relation on said parallel spaced shafts on opposite sides of said driver and separation roller pair in a manner to establish spaced longitudinally extending artificial beam means in said foldover documents to counterbalance any twisting reaction created by separation forces imposed by said roller pair.

2. A document separation system as defined in claim 1 wherein said beam forming roller means includes pairs of confronting rollers on opposite sides of said driver and separation roller pair, at least one roller of each pair of confronting rollers having a concave groove exterior and the other roller of each pair of confronting rollers being substantially complimentary to the corresponding concave grooved roller to form a longitudinally extending transversely curved beam means in the material of said foldover documents.

3. A document separation system as claimed in claim 2 wherein lateral restraining means is provided for embracing at least one edge of said foldover document means as it passes through said separation roller system.

4. A document separation system comprising a pair of externally grooved separation rollers mounted in axially spaced relation on a common shaft, and a complimentary pair of axially spaced drive rollers mounted on a second common shaft parallel to said first shaft, said complimentary separation and drive rollers defining nips therebetween for receiving foldover documents, and being cooperative to distort the material of said foldover documents into the external grooves of said separation rollers so as to form a pair of spaced artificial beam means extending longitudinally of said foldover documents.

5. A document separation system as claimed in claim 4 wherein said system includes means to cause opposite edges of said foldover documents to move closer together as they pass through said nips with the material of said foldover documents being captured in said complimentary separation and driver rollers adjacent opposite edges to maintain said foldover documents in a shallow concave beam-like configuration between the spaced pairs of complimentary separation and driver rollers.

6. A documents separation system as claimed in claim 4 wherein said separation system includes a base support means on which one edge of each of said documents is normally supported, wall means positioned generally normal to said base support means and against which said documents are positioned as they move along said base support means, aperture means in said wall means adapted to telescopically accept the periphery of said driver roller, said grooved separation roller being positioned on the opposite side of said aperture means from said driver roller, both of said rollers being spring loaded toward said wall means, said separation roller including an inner diameter at the base of said groove and an outer diameter defined by upstanding wall means extending radially outwardly from said base on inner diameter of said groove, whereby when a rigid envelope is introduced into said separation system, one face of said envelope rides against said wall means and is maintained in that position by the outer diameter of said separation roller, said spring loaded driver roller being maintained within said slot means and engaging the opposite face of said envelope, and, when a foldover document is introduced into said separation system said spring loaded driver roller will be caused to project through said wall aperture and to force the material from said foldover document into the inner diameter or base of said separation roller, thereby forming a concave beam means complimentary to said grooved separation roller.

7. A document separation system as claimed in claim 6 wherein said driver and separation rollers each have a plurality of pairs of complimentary rollers comprising at least two in number.

8. A method of providing rigidifying means to a foldover document passing through a document separation system which includes at least one passive separation roller system including a pair of axially spaced parallel shafts, a pair of separation rollers mounted in spaced relation on one of said parallel shafts, a pair of driver rollers equally spaced on the other of said parallel shafts and cooperating with the driver rollers to define a pair of nips for the acceptance of said foldover document, one of each of said cooperative pair of rollers having an annular concave grooved periphery and the other of each of said cooperative pair of rollers having a substantially complementary convex grooved periphery, said method comprising the steps of: passing said foldover document through said nips defined between said pairs of driver and separation rollers; and applying reinforcing means to the portion of said foldover document contacting said driver and separation rollers by forming a pair of longitudinally extending, spaced apart curved beam means in the material of said foldover document.

* * * * *